United States Patent [19]

Manke

[11] Patent Number: 4,903,775

[45] Date of Patent: Feb. 27, 1990

[54] WELL SURGING METHOD AND APPARATUS WITH MECHANICAL ACTUATING BACKUP

[75] Inventor: Kevin R. Manke, Marlow, Okla.

[73] Assignee: Halliburton Company, Duncan, Okla.

[21] Appl. No.: 294,439

[22] Filed: Jan. 6, 1989

[51] Int. Cl.[4] ..... E21B 34/10; E21B 34/14; E21B 37/08; E21B 43/12

[52] U.S. Cl. ..... 166/373; 166/149; 166/319; 166/332; 166/374; 166/387

[58] Field of Search ..... 166/374, 373, 332, 319, 166/323, 386, 387, 264, 178, 149, 184, 185, 188

[56] References Cited

U.S. PATENT DOCUMENTS

| | | | |
|---|---|---|---|
| 4,044,829 | 8/1977 | Jessup et al. | 166/264 |
| 4,047,564 | 9/1977 | Nix et al. | 166/72 |
| 4,064,937 | 12/1977 | Barrington | 166/162 |
| 4,278,130 | 7/1981 | Evans et al. | 166/332 |
| 4,422,506 | 12/1983 | Beck | 166/324 |
| 4,467,870 | 8/1984 | Langham | 166/374 X |
| 4,508,174 | 4/1985 | Skinner et al. | 166/373 |
| 4,619,325 | 10/1986 | Zunkel | 166/374 |

OTHER PUBLICATIONS

Halliburton Services Sales & Service Catalog No. 43, pp. 2518–2519.

*Primary Examiner*—Stephen J. Novosad
*Attorney, Agent, or Firm*—James R. Duzan; Neal R. Kennedy

[57] ABSTRACT

A well surging system having pressure actuated ball valves and a mechanical actuating backup for the upper of said ball valves. The apparatus comprises a valve assembly portion containing the upper and lower ball valves which may be independently pressure actuated. The valve assembly portion also includes an extension portion having an extension mandrel therein connected to an upper ball valve actuator. The lower ball valve is opened by increasing the pressure in the well annulus around the valve assembly portion with respect to a flow bore therethrough. The upper ball valve is similarly pressure actuated. In the event that the upper ball valve pressure actuation is fully or partially unsuccessful, a probe assembly portion may be lowered on a wireline into the extension portion adjacent to the valve assembly portion. The probe assembly portion is adapted for releasable engagement with a lug extending inwardly from the extension mandrel. When the probe assembly portion is engaged with the lug, the extension mandrel and the upper ball valve actuator may be lifted by raising the wireline. After this mechanical backup actuation, the probe assembly portion is released from the lug and removed from the tool string.

20 Claims, 4 Drawing Sheets

WELL SURGING METHOD AND APPARATUS WITH MECHANICAL ACTUATING BACKUP

BACKGROUND OF THE INVENTION

1. Field Of The Invention

The present invention relates to a downhole tool for use in oil or gas wells, or the like. This tool is constructed to perform what is known as a "well surging operation" where formation fluid from a zone of the well is rapidly surged out of the formation and into the well to clean debris away from the inner surfaces of the formation and to clean debris from perforations in the well. The tool has pressure actuated ball valves and a backup means for mechanically actuating the upper one of the valves.

2. Description Of The Prior Art

The prior art includes systems for performing surging operations on a well. Any of these prior art systems generally utilize either rupture disks or flapper-type valves to rapidly replace the producing formation in communication with a low pressure chamber in the tool, so that fluid from the well formation will rapidly flow into the tool. One of the most commonly used prior art systems includes a rupture disk which is ruptured by the thrusting action of a plunger.

Although such prior art techniques produce a dynamic surging effect and acceptable drawdown of the producing formation of the well, pieces of the disk itself will sometimes clog choke valves and other rupture equipment connected to the valve after the disk has ruptured. Such a condition most often occurs when the disk does not shatter into fine enough pieces to be circulated out of the well.

Another unfavorable condition that sometimes occurs with these prior art systems is when the disk itself does not completely detach, and instead acts somewhat as a flapper valve in the inner bore of the drill pipe. Under that circumstance, difficulties are presented in circulating fluid upwardly through the drill pipe, due to the flapper valve effect of the partially severed rupture disk. In such situations, the less desirable method of circulating fluids up through the well annulus has to be utilized.

Additionally, the materials, such as aluminum, from which the rupture disks are often constructed are not totally reliable when utilized in corrosive environments. Actions of corrosives weaken the rupture disks and quite often operators experience premature rupture of the disk.

Thus, there has been a need for a well surging system which can provide rapid communication of the well zone with a low pressure chamber, so as to achieve the required rapid surging of fluid from the well zone into the low pressure chamber, and yet avoid the various problems associated above with rupture disk type systems. One such device which has been developed to address this problem is disclosed in U.S. Pat. No. 4,619,325 to Zunkel, assigned to the assignee of the present invention. This well surging system includes an elongated housing assembly having a central flow bore disposed therethrough. Upper and lower independently pressure actuated ball valves are disposed in the housing assembly. Each of the ball valves is independently movable between a closed position wherein the flow bore is closed and an open position wherein the flow bore is open. The upper and lower ball valves define a low pressure surge chamber therebetween when the ball valves are in an initially closed position. This surge chamber is actually a portion of the flow bore.

In the Zunkel apparatus, a packer means is connected to the housing assembly for effectively sealing a well annulus below the housing assembly and a well bore so that a well zone below the packer may be surged.

A lower ball valve operating means is provided in the prior apparatus for opening the lower ball valve prior to opening of the upper ball valve means. When the lower ball valve is opened, well fluid from the well zone surges upwardly through the flow bore of the housing assembly past the opened lower ball valve into the surge chamber. An upper ball valve operating means is provided for opening the upper ball valve after the lower ball valve has been opened. When the upper ball valve is opened, well fluid in the surge chamber may then be circulated upwardly through a bore of a tubing string connected to the well surging apparatus.

This prior art well surging system has worked well, but if for some reason the upper ball valve does not operate with pressure, there is a need to mechanically actuate the apparatus. The present invention provides such a mechanical backup means.

SUMMARY OF THE INVENTION

The well surging system of the present invention is a modification of the prior system described in the abovementioned U.S. Pat. No. 4,619,325. This modification allows the operator to run a probe assembly portion into the well tubing on a wireline and engage an upper ball valve operating means so that the upper ball valve may be mechanically pulled open.

Generally, the well surging apparatus of the present invention comprises a valve assembly portion defining a central flow bore therethrough, the valve assembly portion comprising a ball valve disposed across the flow path. The apparatus further comprises pressure operating means for actuating the ball valve in response to a pressure differential between the flow bore and a well annulus around the valve assembly portion, and mechanical operating means for mechanically actuating the ball valve. The mechanical operating means is normally used in the event that the pressure operating means is inoperable or does not work successfully.

In the preferred embodiment, the mechanical operating means comprises a probe assembly portion positionable adjacent to the valve assembly portion and probe engaging means in operative association with the ball valve for engaging the probe assembly portion such that vertical movement of the probe assembly portion results in actuation of the ball valve. In the preferred embodiment, the probe assembly portion is lowered into the tubing string connected to the apparatus on a wireline.

Connecting means are provided on the probe assembly portion for mutually releasably engaging the probe engaging means. In the preferred embodiment, the probe engaging means comprises a mandrel on the valve assembly portion with an inwardly extending lug thereon, and the connecting means comprises a J-slot member rotatably mounted on the probe assembly portion with J-slot or channel means for receiving and engaging the lug.

The jarring means may comprise a jar adapter, a jar mandrel connected to the jar adapter, and a jar case slidably disposed with respect to the jar adapter and jar mandrel for selectively providing a jarring impulse to at least one of the jar adapter and jar mandrel. Means are provided for preventing relative rotation between the jar case and jar mandrel.

A method of surging a well utilizing the apparatus comprises the steps of positioning, at a predetermined position in a well bore of the well, a tool string comprising upper and lower space ball valves and a packer, initially oriented the ball valves in a closed position such that a surge chamber is defined therebetween, setting the packer into sealing engagement with the well bore at a position above a zone to be surged, after setting the packer opening the lower ball valve such that fluid is surged from the well zone into the tool string past the open lower ball valve and into the surge chamber, and selectively opening the upper ball valve by at least one of pressure actuated and mechanical actuated ball valve operating means. The step of opening the upper ball valve is initially attempted using the pressure actuated ball valve operating means and comprises subsequently using the mechanical actuated ball valve operating means if opening the upper ball valve is not accomplished by pressure actuation. Using the mechanical actuated ball valve operating means preferably comprises lowering a probe assembly on a wireline into the tool string and engaging the pressure actuated ball valve operating means such that at least a portion of the pressure actuated ball valve operating means may be mechanically lifted by raising the wireline. The method further comprises removing the probe assembly from the tool string after the upper ball valve is opened.

Numerous objects, features and advantages of the present invention will become readily apparent to those skilled in the art upon a review of the following disclosure when taken in conjunction with the accompanying drawings.

DETAILED DESCRIPTION OF THE PREFERRED EMBODIMENT

Figures 1, 2, 3:
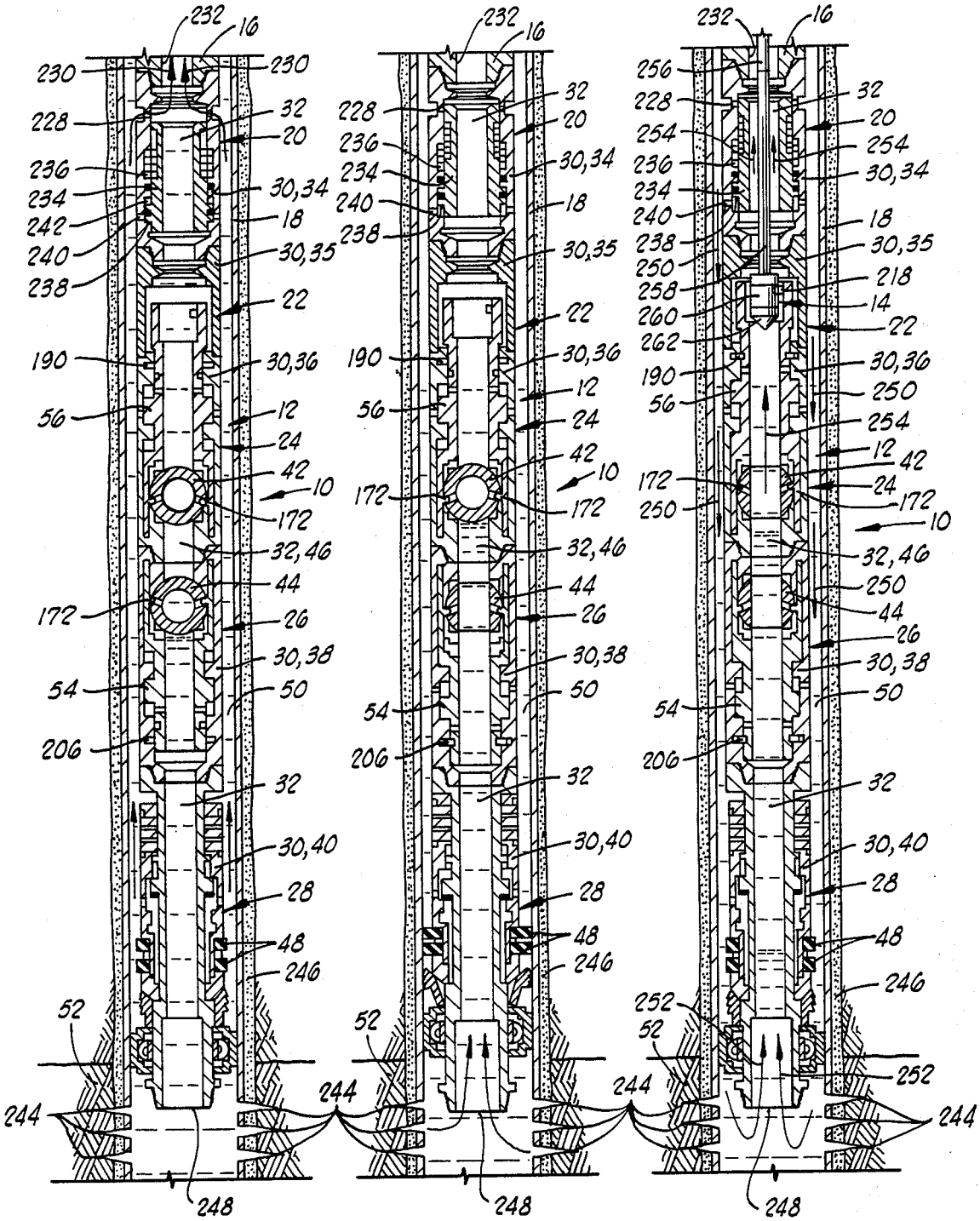
FIG. 1 is a schematic cross-sectional view of the valve assembly portion of the well surging apparatus with mechanical backup of the present invention as the valve assembly portion is lowered into the well on the well tubing or tubing string.
FIG. 2 is a view similar to FIG. 1 after a packer means on the apparatus has been set and the lower ball valve has been opened so that formation fluid has surged into a surge chamber between the upper and lower ball valves.
FIG. 3 is a view similar to FIG. 1 showing the upper ball valve in its open position, the packer in its retracted position, the wireline probe assembly portion in place and engaged with a lugged mandrel in the valve assembly portion, and also showing well fluid being circulated up the tubing string.

Referring now to the drawings, and more particularly to FIGS. 1–3, the well surging apparatus with mechanical backup of the present invention is shown and generally designated by the numeral 10. Apparatus 10 generally comprises an outer, valve assembly portion 12 shown in each of FIGS. 1–3 and an inner, probe assembly portion 14, the probe assembly portion illustrated in FIG. 3.

Valve assembly portion 12 is suspended by a tubing string or well tubing 16 within a well defined by a well casing 18. Probe assembly portion 14 is suspended on a wireline (not shown) of a kind known in the art.

The Valve Assembly Portion

Valve assembly portion 12 comprises an upper fill-up valve section 20, an extension section 22, an upper ball valve section 24, a lower ball valve section 26, and a packer section 28. Except for extension section 22, valve assembly portion 12 of the present invention is substantially identical to the apparatus disclosed in prior U.S. Pat. No. 4,619,325, discussed above, and hereby incorporated herein by reference.

Valve assembly portion 12 includes an elongated housing assembly 30 having a central flow bore 32 disposed therethrough. Housing assembly 30 includes a fill-up valve housing 34, an extension section housing 35, an upper ball valve housing 36, a lower ball valve housing 38, and a packer section housing 40.

Upper and lower ball valve sections 36 and 38 include upper and lower independently operable, pressure actuated ball valves 42 and 44, respectively, disposed in housing 30. Each of ball valves 42 and 44 is independently movable between a closed position as illustrated in FIG. 1 wherein flow bore 32 is closed and an open position as illustrated in FIG. 3 wherein flow bore 32 is open.

When upper and lower ball valves 42 and 44 are in their closed positions as illustrated in FIG. 1, they define a low pressure surge chamber 46 therebetween filled with ambient air at atmospheric pressure. It will be seen that surge chamber 46 is actually a portion of flow bore 32.

Although in the schematic illustration of FIG. 1, upper and lower ball valve sections 24 and 26 are shown directly connected together, any number of stands of spacer tubing may be placed between the upper and lower ball valve sections so that surge chamber 46 may have a length in the range of 100 to 3,000 feet. Normally, surge chamber 46 will have a length in the range of 1,000 to 2,000 feet.

Packer section 28 includes an expandable packer means 48 connected to packer section housing 40 of housing portion 30 for selectively sealing a well annulus 50 between housing portion 30 and the well bore defined by casing 18 so that a well zone 52 below the packer means 48 may be surged.

A lower ball valve operating means 54 is provided for opening lower ball valve 44 prior to opening upper ball valve 42, in a manner that will be described below.

An upper ball valve operating means 56 is provided for opening upper ball valve 42 after lower ball valve 44 has been opened, again in a manner that will be described below.

Figure 4A:
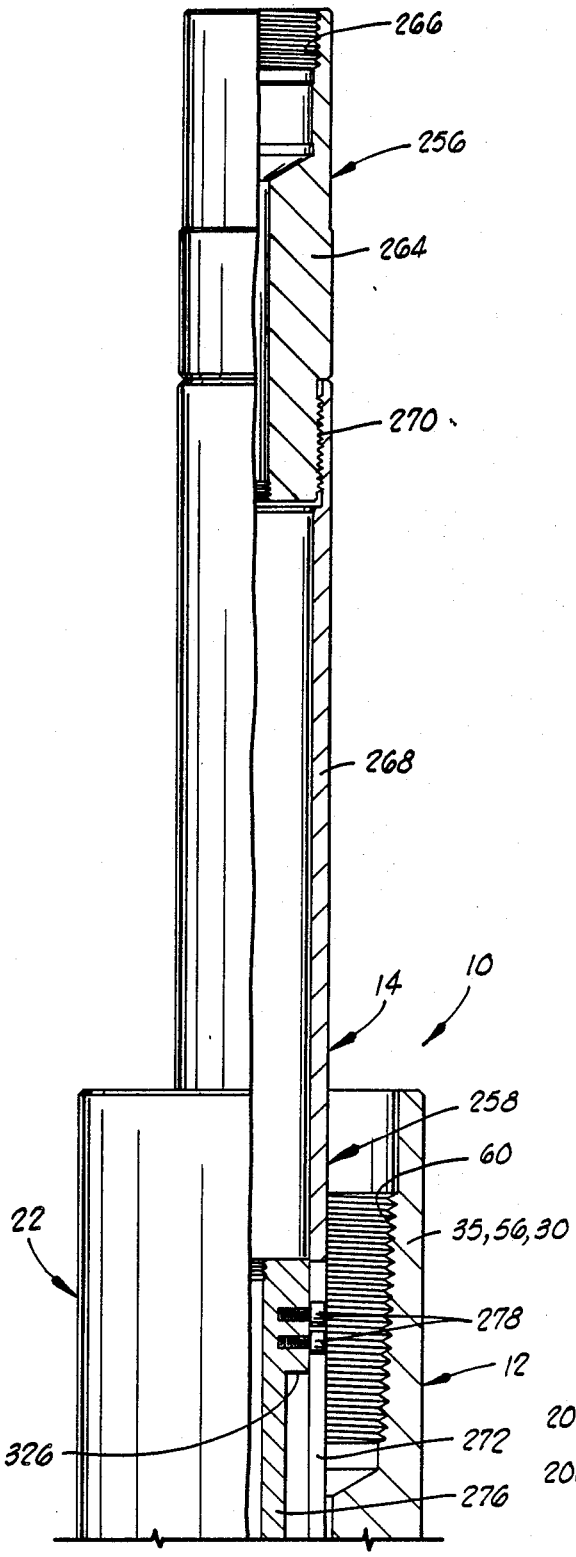
FIGS. 4A–4E shows a partial longitudinally cross-sectional view of the extension and upper ball valve assembly portions of the apparatus with the wireline probe assembly portion positioned in the extension portion.
Figure 4B:
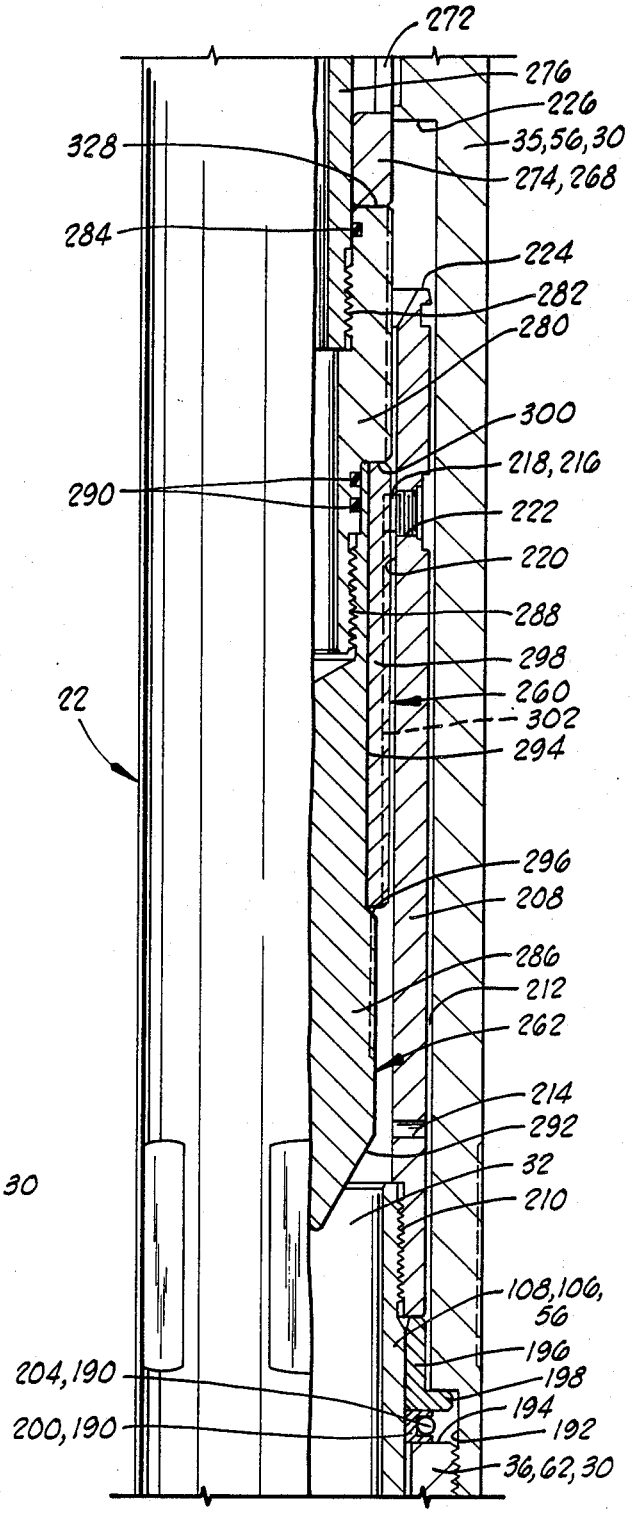

Referring now to FIGS. 4A–4E, details of extension section 22 and upper ball valve section 24 of valve assembly portion 12 are shown. Also shown in FIGS. 4A and 4B are details of probe assembly portion 14. In reading the discussion concerning the details of upper ball valve section 24, it should be understood that lower ball valve section 26 is substantially similarly constructed, but is turned upside down relative to upper ball valve section 24.

Extension section housing 35 is characterized by an upper adapter 56. Upper adapter 56 has a threaded bore 60 adapted for threading engagement with fill-up valve housing 34.

Upper ball valve housing 36 includes a power section housing 62, a middle adapter 64, a ball housing 66, and a lower adapter 68. Lower adapter 68 has an external threaded surface 70 adapted for threading engagement with a corresponding upper adapter of lower ball valve housing 38.

Figure 4C:
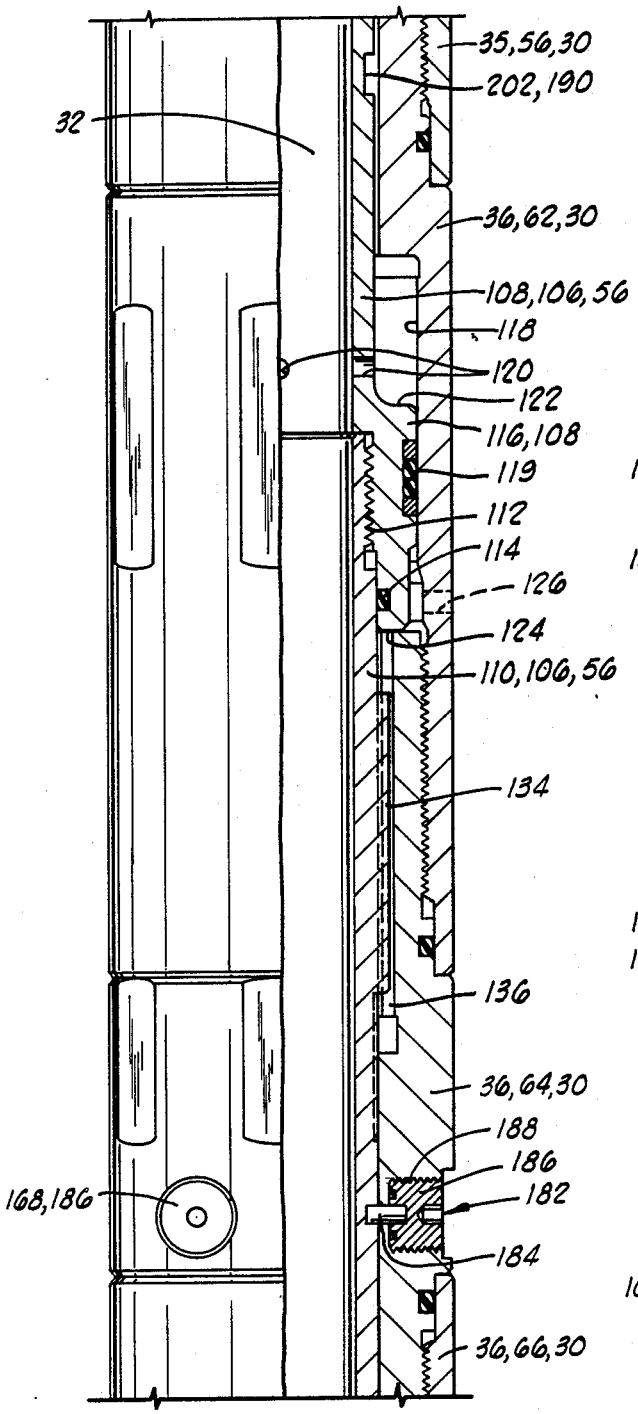
Figure 4D:
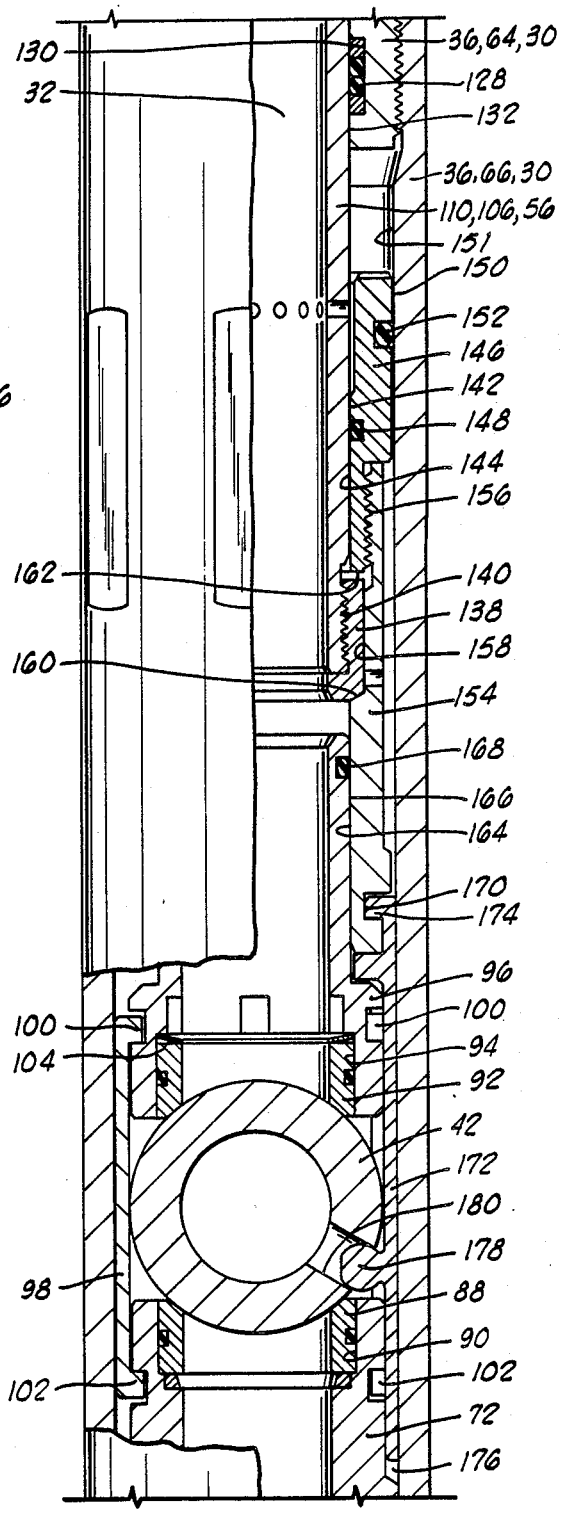
Figure 4E:
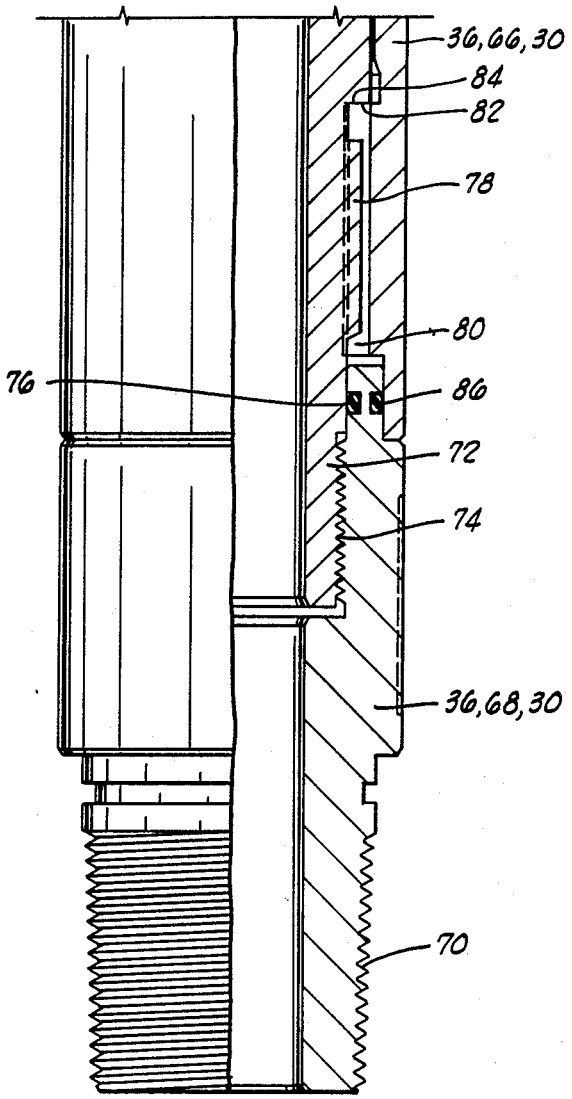

Referring to FIG. 4E, a lower seat holder mandrel 72 is threadedly connected to lower adapter 68 at threaded connection 74 with a seal being provided therebetween by O-ring 76.

Lower seat holder mandrel 72 includes a plurality of radially outwardly extending splines 78 which are meshed with a plurality of radially inwardly extending splines 80 of ball housing 66 to prevent relative rotational motion therebetween.

A downwardly facing shoulder 82 of lower seat holder mandrel 72 engages upper ends 84 of splines 80 to hold ball housing 66 in place relative to lower adapter 68. A seal is provided between lower adapter 68 and ball housing 66 by O-ring 86.

Referring now to FIG. 4D, lower seat holder mandrel 72 has a lower annular seat 88 received in an upwardly opening counterbore 90 thereof.

Upper ball valve 42 is rotatably held between lower annular seat 88 and a similar upper annular seat 92. Upper annular seat 92 is received within a downwardly opening counterbore 94 of an upper seat holder mandrel 96.

Upper and lower seat holder mandrels 96 and 72 are held in place relative to each other by a plurality of C-clamps 98 having upper and lower ends 100 and 102 which extend into corresponding grooves in the upper and lower seat holder mandrels.

Upper seat 92 is biased downwardly against upper ball valve 42 by a Belleville-type spring 104.

Upper ball valve operating means 56 is constructed to be actuated in response to an increase in fluid pressure within well annulus 50 above packer means 48 relative to fluid pressure within flow bore 32. This is accomplished in the following manner.

As seen in FIGS. 4B–4D, upper ball valve operator means 56 comprises an actuating mandrel 106 having upper and lower actuating mandrel sections 108 and 110, respectively, which are threadedly connected at threaded connection 112 with an O-ring seal 114 being provided therebetween.

Upper actuating mandrel section 108 has a power piston 116 defined thereon which is slidably received within a cylindrical bore 118 of power section housing 62. Power piston 116 includes piston seals 119 for sealing between power piston 116 and bore 118.

Upper actuating mandrel section 108 has a plurality of ports 120 disposed therethrough placing an upper side 122 of power piston 116 in communication with flow bore 32 above upper ball valve 42.

A lower side 124 of power piston 116 is communicated with well annulus 50 through a power port 126 disposed through the wall of power section housing 62.

The outside diameter of power piston 116 is defined by seals 119 engaged with bore 118, and the inside diameter of the power piston 116 is defined by seals 128 which are contained in a radially inner groove 130 of middle adapter 64, and which engage an outer diameter 132 of lower actuating mandrel section 110. Thus, any pressure differential between well annulus 50 and flow bore 32 will act across power piston 116.

Lower actuating mandrel section 110 includes a plurality of radially outwardly extending splines 134 which are meshed with a plurality of radially inwardly extending splines 136 of middle adapter 64 to prevent relative rotation therebetween.

A threaded cap 138 is connected to the lower end of lower actuating mandrel section 110 at threaded connection 140.

A lower portion 142 of outer diameter 132 of lower actuating mandrel section 110 is slidably received within a bore 144 of an actuating ring 146, with a seal being provided therebetween by O-ring 148.

An outer surface 150 of actuating ring 146 is closely received within a bore 151 of ball housing 66 with a sliding seal being provided therebetween by O-ring 152.

Actuating ring 146 is connected to a cylindrical actuating sleeve 154 at threaded connection 156.

Threaded cap 138 is closely received within an upper bore 158 of actuating sleeve 154, and is vertically trapped between an upwardly facing tapered surface 160 of actuating sleeve 154 and a lower end 162 of actuating ring 146. Thus, vertical motion of actuating mandrel 106 due to forces exerted on power piston 116 is transferred to actuating ring 146 and actuating sleeve 154.

Actuating sleeve 154 has a lower bore 164 within which is closely received an outer cylindrical surface 166 of upper seat holder mandrel 96, with a seal being provided therebetween by O-ring 168.

Actuating sleeve 154 has a radially outer annular groove 170 disposed in its lower end portion.

An actuating arm 172 has a radially inwardly extending upper flange 174 which is received within groove 170 of actuating sleeve 154. Actuating arm 172 is a substantially longitudinal member, being arcuate in cross section, and slides in a longitudinal space 176 between ball housing 66 and each of the upper seat holder mandrel 96, upper ball valve 42 and lower seat holder mandrel 72.

There is a second actuating arm such as actuating arm 172, which is circumferentially located from the first actuating arm 172 and which is not shown in FIG. 4D, but is illustrated schematically in FIGS. 1–3.

An actuating lug 178 extends radially inwardly from actuating arm 172 and is received within an eccentric bore 180 disposed through the wall of upper ball valve 42.

When actuating mandrel 106 is moved upwardly relative to upper ball valve housing 36 due to upward forces acting on power piston 116, in the manner further described herein, actuating arm 172 is moved upwardly relative to upper ball valve 42 and actuating lug 178 rotates upper hall valve 42 from its closed position shown in FIG. 4D and schematically shown in FIGS. 1 and 2 to an open position like that schematically illustrated in FIG. 3.

Referring to FIG. 4C, upper ball valve section 24 includes an upper releasable retaining means 182 operably associated with upper ball valve operating means 56 for releasably retaining upper ball valve 42 in its initial closed position until fluid pressure in well annulus 50 exceeds fluid pressure in flow bore 32 above upper ball valve 42 by a first predetermined pressure differential. Upper releasable retaining means 182 includes a plurality of upper shear pins 184 disposed between middle adapter 64 of upper ball valve housing 36 and lower actuating mandrel section 110 of actuating mandrel 106 of upper ball valve operating means 56. Each of upper shear pins 184 is held in place by a substantially cylindrical radially oriented shear pin holder 186 which is threadedly received at threaded connection 188 within a radial bore of middle adapter 64.

As will be understood by those skilled in the art, the pressure differential between well annulus 50 and flow bore 32 above upper ball valve 42 required to shear the shear pins 184 depends on the number, material and size of the shear pins.

Lower ball valve section 26, as previously mentioned, is constructed in a substantially identical fashion as upper ball valve section 24 except that it is inverted relative to the orientation of upper ball valve housing 24. It also, therefore, includes shear pins such as shear pins 184.

Referring now to FIGS. 4B and 4C, upper ball valve section 24 also includes an upper locking means 190 operably associated with upper ball valve operating means 56 for locking upper ball valve 42 in its open position to prevent reclosure thereof. A portion of upper locking means 190 is received in a radially inner groove 192 of extension section housing 35 adjacent an upper end 194 of power section housing 62 of upper ball valve housing 36. A spacer 196, having a radially outwardly extending flange portion which extends into groove 194, helps longitudinally position the portion of locking means 190 within groove 194.

Upper locking means 190 includes a plurality of radially inwardly resiliently biased locking dogs 200 which are arranged to engage a radially outer groove 202 of upper actuating mandrel section 108 when upper ball valve 42 is in its open position. An annular resilient band 204 encircles locking dogs 200 to bias them radially inwardly.

Referring again to FIG. 1, lower ball valve section 26 includes a lower locking means 206 constructed in a manner similar to that of upper locking means 190 just described.

Referring now to FIGS. 4A and 4B which show the details of extension section 22, an elongated extension mandrel 208 is disposed in extension section housing 35 and is attached to upper actuating mandrel section 108 of upper ball valve operating means 56 at threaded connection 210. Extension mandrel 208 is spaced radially inwardly from extension section housing 35 such that an annular volume 212 is defined therebetween. A substantially transverse port 214 is defined through extension mandrel 208 in a lower portion thereof. It will be seen that port 214 provides communication between annular volume 212 and flow bore 32 above upper ball valve 42.

A probe engaging means 216 is provided on an upper portion of extension mandrel 208. Preferably, probe engaging means 216 is in the form of at least one lug 218 which extends radially inwardly from bore 220 of extension mandrel 208. Lug 218 is preferably engaged with a substantially transverse threaded bore 222 in extension mandrel 208. Thus, extension mandrel 208 may also be referred to as a lugged mandrel 208. Upper end 224 of extension mandrel 208 faces a downwardly facing shoulder 226 in extension section housing 35. As seen in FIG. 4B, upper end 224 is spaced downwardly from shoulder 226 when upper ball valve 42 is in the closed position.

Pressure Operation Of The Well Surging System

FIG. 1 illustrates well surging apparatus 10 in its initial orientation as it is lowered into the well bore defined by well casing 18. Apparatus 10 is initially oriented so that upper and lower ball valves 42 and 44 are in their closed positions, thus defining surge chamber 46 therebetween. Surge chamber 46 is initially filled with ambient air at atmospheric pressure, and thus provides a relatively low pressure chamber as compared to the hydrostatic well fluid pressures within the well and as compared to the pressures of formation fluid within zone 52 of the well.

Also, in the initial orientation of apparatus 10, expandable packer means 48 of packer section 28 is in a retracted position as illustrated in FIG. 1 so that apparatus 10 may be lowered into the well.

As previously mentioned, apparatus 10 includes a fill-up valve section 20 located above extension section 22. Fill-up valve section 20 includes a plurality of radial ports such as 228 which communicate well annulus 50 with flow bore 32 above upper ball valve 42.

Fill-up valve 20 is initially in an open position as illustrated in FIG. 1, when apparatus 10 is lowered into the well. This permits well fluid from annulus 50 to flow into flow bore 32 as indicated by arrows 230 and into a tubing bore 232 of well tubing 16 so as to fill up the tubing string as apparatus 10 is lowered into the well.

Fill-up valve section 20 includes the fill-up valve housing 34 previously mentioned and a concentric inner sliding valve sleeve 234. Valve sleeve 234 is initially held in the open position relative to fill-up valve housing 34 as shown in FIG. 1 by a shear pin set 236.

A differential pressure actuating piston 238 is defined upon valve sleeve 234 and slides within an inner bore of fill-up valve housing 34.

A power port 240 disposed through fill-up valve housing 34 communicates well annulus 50 with the lower side of actuating piston 238. The upper side of actuating piston 238 is communicated with a sealed low pressure chamber 242. Thus, when the upward pressure differential acting across actuating piston 238 reaches a predetermined value, which is determined by the construction of shear pin set 236, shear pin set 236 will shear, allowing valve sleeve 234 to move upwardly to a closed position, closing ports 228, as illustrated in FIGS. 2 and 3.

Fill-up valve section 20 may be constructed so as to have ports 228 close at a predetermined depth within the well by designing the shear pin set 236 to shear at the hydrostatic pressure in well annulus 50 corresponding to that predetermined depth, or the fill-up valve section may be constructed so that additional pressure will need to be provided to well annulus 50 to shear the shear pin set 236.

In any regard, as well surging apparatus 10 is initially lowered into the well as shown in FIG. 1, ports 228 of the fill-up valve section will be maintained open until apparatus 10 is located in substantially its final desired position.

As apparatus 10 is lowered into the well, upper and lower ball valves 42 and 44 are releasably retained in their initial closed positions as shown in FIG. 1 by releasable shear means 182 including shear pins such as 184 shown in FIG. 4C for the upper ball valve.

In FIG. 1, well surging apparatus 10 is shown as having been placed at a desired final location such that the expandable packer means 48 is located at an elevation above zone 52 which is to be surged. FIG. 1 schematically illustrates a plurality of perforations 244 which have been created through well casing 18, through a cement sheath 246 surrounding well casing 18, and into formation 52 itself, in a manner that is well known to those skilled in the art.

The purpose of the well surging operation is primarily to clean perforations 244 of the debris that is created when the perforations are initially formed.

As is apparent in FIG. 1, zone 52 is communicated through perforations 244 with flow bore 32 below lower ball valve 44 through an open lower end 248 of packer section 28. The fluid from formation 52 is separated from low pressure surge chamber 46 by closed lower ball valve 44.

After well surging apparatus 10 is located at its desired final position as illustrated in FIG. 1, expandable packer means 48 is set as illustrated in FIG. 2 to seal well annulus 50 at an elevation above zone 52. Packer section 28 is of a conventional design well known to those skilled in the art, and is set by slightly rotating apparatus 10 to actuate a J-slot mechanism and setting weight down on the tubing string and apparatus 10 to cause expandable packer means 48 to be compressed longitudinally and thus expanded radially outwardly as schematically illustrated in FIG. 2.

Subsequent to setting expandable packer means 48, zone 52 of the well can be surged by opening lower ball valve 44 to allow fluid from formation 52 to rapidly surge into low pressure surge chamber 46. It is necessary that lower ball valve 44 be opened without opening upper ball valve 42.

As previously described, upper and lower ball valve sections 24 and 26 are constructed so that upper and lower ball valves 42 and 44 are operated in response to an increase in pressure within well annulus 50 relative to flow bore 32. This increase in differential pressure is applied across power pistons, such as power piston 116 described for upper ball valve 42, thereby shearing shear pins such as 184 and rotating the corresponding ball valve to its open position. Preferably, upper and lower ball valve sections 24 and 26 are constructed to be opened at substantially equal differential pressures across their respective power pistons. This, however, requires that a particular procedure be utilized to prevent application of differential pressure across power piston 116 of upper ball valve section 24 while applying a differential pressure across the power piston of lower ball valve section 26. This is preferably accomplished in the following manner.

As previously mentioned, fill-up valve section 20 is moved to a closed position as illustrated in FIG. 2 wherein ports 228 are closed by valve sleeve 234, prior to opening either of upper and lower ball valves 42 and 44. Then, the fluid in tubing bore 232 and in flow bore 32 above the closed upper ball valve 42 is pressurized to a pressure sufficient to prevent opening of the upper ball valve when lower ball valve 44 is subsequently actuated and opened. Shear pins 184 of upper and lower ball valve sections 24 and 26 are preferably designed to be sheared at a differential pressure across their respective power pistons in the range of 1,000 to 1,500 psi. Thus, to initially prevent actuation of upper ball valve 42 while lower ball valve 44 is being opened, the fluid within tubing bore 232 and in flow bore 32 above upper ball valve 42 is preferably initially pressurized to approximately 1,500 psi above hydrostatic pressure. It should be remembered that the pressure in flow bore 32 below lower ball valve 44 will still be at substantially hydrostatic pressure. Then, the pressure in well annulus 50 above expanded packer means 48 is increased to approximately 1,500 psi above hydrostatic pressure. Since the pressure in flow bore 32 below lower ball valve 44 is still at hydrostatic pressure, this will apply a downward pressure differential of 1,500 psi across the power piston of lower ball valve section 26, thus causing shear pins 184 thereof to shear and thereby allowing the actuating mandrel and lower ball valve section 26 to be moved downwardly. This downward motion of the actuating mandrel rotates lower ball valve 44 to its open position as illustrated in FIG. 2.

Throughout this operation, the pressure within tubing bore 232 and within flow bore 32 above upper ball valve 42 is maintained at an increased pressure of approximately 1,500 psi above hydrostatic pressure, so that there will be no substantial pressure differential across power piston 116 of upper ball valve section 24.

Once lower ball valve 44 is rotated to its open position, which will occur very rapidly upon shearing of shear pins 184 thereof, well fluid from zone 52 will rapidly surge inwardly through perforations 244 into open lower end 248 of packer section 28, upwardly through flow bore 32 past opened lower ball valve 44 and into low pressure surge chamber 46. This very rapid fluid flow through perforations 244 will cause debris located in these perforations and adjacent to the faces of the producing formation to be swept out of the formations 244, thus ultimately significantly increasing the producing capabilities of the well.

Often, after lower ball valve 44 has been opened to surge the well, upper ball valve 42 will be maintained in its closed position for a period of time of perhaps one hour. Then, upper ball valve 42 is opened. Upper ball valve 42 is opened by creating a pressure differential across power piston 116 of upper ball valve section 24, as already described. Again, it is noted that the construction of lower ball valve section 26 is substantially identical to that of upper ball valve section 24 shown in FIGS. 4A–4E, except that the lower ball valve section is upside down with respect to the upper ball valve section.

The increased pressure which was previously applied to flow bore 32 above upper ball valve 42 is released. Then, well annulus 50 is pressurized to a pressure approximately 1,500 psi above the hydrostatic pressure within flow bore 32 above upper ball valve 42, thus shearing shear pins 184 thereof to rotate upper ball valve 42 to its open position as illustrated in FIG. 3.

Expandable packer means 48 is then released. This is accomplished by relieving the pressure from well annulus 50 and picking up on well tubing 16 and well surging apparatus 10 to cause packer means 48 to retract as shown in FIG. 3.

At this point, well fluid contained in surge chamber 46 and in flow bore 32 and tubing bore 232 is circulated upwardly through tubing bore 232 by pumping fluid downwardly through well annulus 50 as indicated by arrows 250. This fluid enters lower end 248 of packer section 28 as indicated by arrows 252, and the fluid flows upwardly through flow bore 32 as indicated by arrows 254. It should be noted at this point that, while probe assembly portion 14 is shown in FIG. 3, the probe assembly portion is not actually present in valve assembly portion 12. In other words, flow bore 32 is fully opened to allow fluid flow upwardly therethrough.

Upper and lower ball valves 42 and 44 are locked into their open positions by the upper and lower locking means 190 and 206, respectively, to prevent reclosure of the ball valves.

A number of advantages are provided by the system as compared to prior art systems utilizing flapper valves and disk valves. There is no debris created from actuation of the surge tool, since the tool is actuated by merely rotating ball valves and there is no disc which is ruptured. The rapid opening ability of the ball valve provides almost instantaneous surging of the fluid from the zone of the well. The ball valve structure is very reliable in its opening capabilities. The ball valve structure also provides a large internal diameter allowing ample flow area for rapid recovery of fluid from the well. With the ball valve arrangement, well fluid can always be circulated outwardly through the tubing string rather than having to utilize the well annulus for circulating, as is sometimes the case when using disk-type valves.

Additionally, annulus pressure responsive ball valves having shear pins initially holding the ball valves closed and having the rapid instantaneous movement achieved when the shear pin is sheared, provide a reliable indication at the surface that the tool is open.

The Probe Assembly Portion

The above-described pressure operation of the well surging system is essentially identical to that described in the previously cited U.S. Pat. No. 4,619,325 which has been incorporated herein by reference. The present invention adds the additional feature of a mechanically actuated backup means for opening upper ball valve 42 in the event that it is not possible to open the upper ball valve by the pressurizing procedure already described. This is accomplished by lowering probe assembly portion 14 into well tubing 16 on a wireline of a kind known in the art to engage lug 218 on extension mandrel 208. Extension mandrel 208 and actuating mandrel 106 then may be mechanically lifted by raising the wireline, thus providing a backup mechanical means for opening upper ball valve 42, as will be further described herein.

Referring again to FIGS. 4A and 4B, the upper end of probe assembly portion 14 comprises a coupling means 256, a jarring means 258, a connector means 260 and a probe guide means 262.

Coupling means 256 may be of any kind known in the art used to connect a device to a wireline, such as top coupling member 264 having a threaded bore 266 at the upper end thereof.

At the upper end of jarring means 258 is a jar case 268 attached at its upper end to top coupling member 264 at threaded connection 270. Jar case 268 defines an elongated, longitudinally extending slot 272 therein and has an enlarged striker block portion 274 located at the lower end of slot 272.

Slidably disposed in jar case 268 and forming another portion of jarring means 258 is a jar mandrel 276. The heads of a plurality of screws 278 extend from an upper portion of jar mandrel 276 into slot 272 in jar case 268. Screws 278 permit sliding relationship between jar mandrel 276 and jar case 268, but prevent rotational movement of jar case 268 relative to jar mandrel 276 and probe guide means 262.

The lower end of jar mandrel 276 is attached to a jar adapter 280 at threaded connection 282 with an O-ring 284 providing sealing therebetween. In the embodiment illustrated, jar adapter 280 is the lower component of jarring means 258.

Probe guide means 262 is adapted for guiding and aligning probe assembly portion 14 as it is lowered into the upper end of valve assembly portion 12 of apparatus 10. Probe guide means 262 is preferably characterized by a guide body 286 attached at its upper end to jar adapter 280 at threaded connection 288. O-rings 290 provide sealing between guide body 286 and jar adapter 280. The lower portion of guide body 286 forms a downwardly facing, substantially conical tip 292. The upper portion of guide body 286 has an outside diameter 294 with a generally upwardly facing shoulder 296 at the lower end thereof.

In the preferred embodiment, connector means 260 comprises a J-slot or channel member 298 rotatably mounted on outside diameter 294 of guide body 286. J-slot member 298 is longitudinally fixed with respect to guide body 286 between shoulder 296 thereon and downwardly facing shoulder 300 on jar adapter 280.

Figure 5:
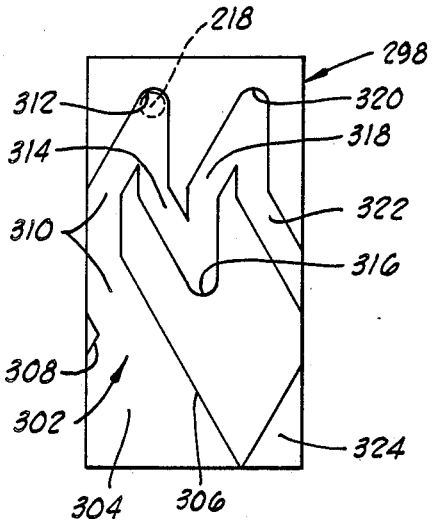
FIG. 5 is a layout view of a J-slot member on the probe assembly portion.

Referring now also to FIG. 5, J-slot member 298 defines a J-slot or channel means 302 therein. Channel means 302 cooperates with probe engaging means 216 in extension section 22 so that upper ball valve operating means 56 may be mechanically actuated to open upper ball valve 42.

Channel means 302 includes an entry channel 304 defined in part by walls 306 and 308. Entry channel 304 provides an area for receiving and engaging lug 218 of probe engaging means 216 as probe assembly portion 14 is lowered into valve assembly portion 12. Entry channel 304 opens downwardly at its lower end and at its upper end is in communication with a first channel 310. The downward distance which probe assembly portion 14 can be advanced is limited by an upper wall 312 of first channel 310.

Channel means 302 also includes a second channel 314 which extends downwardly from and is in communication with wall 312 and the upper end of first channel 310. The extent to which probe assembly 14 can be moved upwardly without contacting lug 218 is limited by a lower wall 316 at the bottom of second channel 314.

Channel means 302 further includes a third channel 318 which extends upwardly from wall 316 and the lower end of second channel 314. Again, the distance which probe assembly portion 14 can be advanced downwardly is limited by an upper wall 320.

Channel means 302 also includes a fourth channel 322 which extends downwardly from upper wall 320 and the upper end of third channel 318.

Finally, channel means 302 includes an exit channel 324 which is in communication with fourth channel 322 in a manner substantially identical to the communication between entry channel 304 and first channel 310.

Manual Operation Of The Well Surging System

In the event that it is not possible to carry out the pressure operation of upper ball valve means 56 to open upper ball valve 42, the present invention provides a backup means for mechanically opening the upper ball valve. Probe assembly portion 14 is lowered into well tubing 16, as already mentioned, on a wireline connected to coupling means 256. The wireline is of a kind known in the art and is therefore not shown in the drawings.

As probe assembly portion 14 enters valve assembly portion 12, conical tip 292 of guide means 262 centers the probe assembly in extension section 22. As connecting means 260 is lowered adjacent to probe engaging means 216, lug 218 enters entry channel 304 of channel means 302. Angled walls 306 and 308 direct lug 218 into first channel 310. It will be seen that probe assembly portion 14 may thus be lowered into housing assembly portion 12 until lug 218 contacts upper wall 312.

Raising the wireline, and thus raising probe assembly portion 14, causes J-slot member 298 to be raised such that lug 218 enters second channel 314 and eventually engages lower wall 316. This results in a resistance on the wireline which is observable by the operator. Because J-slot member 298 is free to rotate about guide body 286, it will be seen that rotational movement of probe assembly portion 14 is substantially eliminated.

Further lifting on the wireline and probe assembly portion 14 will thus be seen to cause lug 218 and extension mandrel 208 to be raised. Because extension mandrel 208 is attached to upper actuating mandrel section 108 of actuating mandrel 106 of upper ball valve operating means 56, the upper ball valve operating means will be raised which of course rotates upper ball valve 42 to its open position just as if upper ball valve operating means 56 had been pressure actuated.

Once upper ball valve 42 has been opened, locking means 190 will lock the upper ball valve in its open position in the manner already described. At this point, probe assembly 14 is removed from valve assembly portion 12 and well tubing 16. This is accomplished by again lowering probe assembly portion 14 on the wireline. This causes lug 218 to be directed into third channel 318 until lug 218 engages upper wall 320.

Again lifting on the wireline raises probe assembly portion 14 such that lug 218 is directed into fourth channel 322 and then into exit channel 324, at which point probe assembly portion 14 is freed from valve assembly portion 12.

Referring still to FIGS. 4A and 4B which show jarring means 258, it will be seen that striker block portion 274 of jar case 268 is movable between a downwardly facing shoulder 326 on jar mandrel 276 and upwardly facing end 328 of jar adapter 280.

The coupling and uncoupling of coupling means 260 on probe assembly portion 14 with probe engaging means 216 in extension section 22 of valve assembly portion 12 is generally achieved by the longitudinal reciprocating movement of the wireline cable as already described. If the coupling between connecting means 260 and probe engaging means 216 becomes jammed, such as if lug 218 becomes stuck in channel means 302, the coupling or uncoupling may be facilitated by using jarring means 258.

For example, if probe assembly portion 14 needs to be moved farther down into the well, the wireline may be withdrawn so that striker block portion 274 of jar case 268 is positioned adjacent to shoulder 326 of jar mandrel 276. With striker block portion 274 so positioned, the wireline may be released so that the striker block and everything connected thereto will drop rapidly to apply a force impulse to end 328 of jar adapter 280. Also, if the connection between connector means 260 and probe engaging means 216 is stuck such that probe assembly portion 14 needs to be moved in an upward direction, the jarring procedure may be reversed so that striker block portion 274 of jar case 268 is positioned adjacent to end 328 as shown in FIG. 4B. Quick upward movement accomplished by rapid intake of the wireline cable on the hoist means associated therewith (not shown) will raise striker block portion 274 rapidly so that a force impulse is applied to shoulder 326 of jar mandrel 276.

It will thus be seen that a backup means is provided in the present invention for mechanically opening the upper ball valve of the well surging system.

It will be seen, therefore, that the well surging system with mechanical backup of the present invention is well adapted to attain the ends and advantages mentioned as well as those inherent therein. While a presently preferred embodiment of the invention has been described for the purposes of this disclosure, numerous changes in the arrangement and construction of parts may be made by those skilled in the art. All such changes are encompassed within the scope and spirit of the appended claims.

What is claimed is:

1. A well surging apparatus comprising:

a valve assembly portion defining a central flow bore therethrough and comprising a ball valve disposed across said flow path;

pressure operating means for actuating said ball valve in response to a pressure differential between said flow bore and a well annulus around said valve assembly portion; and mechanical operating means for mechanically actuating said ball valve and comprising a portion separable from, and positionable adjacent to, said valve assembly portion.

2. A well surging apparatus comprising:

a valve assembly portion defining a central flow bore therethrough and comprising a ball valve disposed across said flow path;

pressure operating means for actuating said ball valve in response to a pressure differential between said flow bore and a well annulus around said valve assembly portion; and mechanical operating means for mechanically actuating said ball valve, said mechanical operating means comprising:

a probe assembly portion positionable adjacent to said valve assembly portion; and probe engaging means in operative association with said ball valve for engaging said probe assembly portion such that vertical movement of said probe assembly portion results in actuation of said ball valve.

3. The apparatus of claim 2 further comprising jarring means on said probe assembly portion for jarring said probe assembly portion with respect to said probe engaging means.

4. The apparatus of claim 2 further comprising connecting means on said probe assembly portion for mutually releasably engaging said probe engaging means.

5. The apparatus of claim 4 further comprising jarring means in operative association with said connecting means for jarring said connecting means with respect to said probe engaging means.

6. The apparatus of claim 4 wherein said connecting means is rotatably mounted on said probe assembly portion.

7. The apparatus of claim 4 wherein:

said probe engaging means comprises a mandrel extending from said valve assembly portion with an inwardly extending lug thereon; and said connecting means comprises a J-slot member with channel means for receiving and engaging said lug.

8. A well surging apparatus for use in a well bore comprising:

a valve assembly portion defining a central flow bore therethrough and comprising upper and lower ball valves, each of said ball valves being independently movable between a closed position wherein said flow bore is closed and an open position wherein said flow bore is open, said upper and lower ball valves defining a low pressure surge chamber therebetween when said ball valves are in an initially closed position;

packer means connected to said valve assembly portion for sealingly engaging said well bore so that a well zone below said packer means may be surged;

lower ball valve operating means for opening said lower ball valve prior to opening said upper ball valve so that well fluid from said well zone may surge upwardly through said flow bore past the open lower ball valve into said surge chamber;

pressure actuated upper ball valve operating means for opening said upper ball valve after said lower ball valve has been opened and thereby allowing well fluid in said surge chamber to be circulated upwardly through said flow bore, said pressure actuated upper ball valve operating means being adapted for opening said upper ball valve in response to an increase in fluid pressure in a well annulus above said packer means relative to a fluid pressure within said flow bore; and mechanically actuated upper ball valve opening means for opening said upper ball valve after said lower ball valve has been opened in the event of inoperability of said pressure actuated upper ball valve operating means.

9. The apparatus of claim 8 wherein said mechanically actuated upper ball valve operating means comprises:

probe engaging means connected to said pressure actuated upper ball valve operating means; and a probe assembly portion positionable on a wireline adjacent to said probe engaging means and engagable with said probe engaging means such that said probe engaging means may be lifted by raising said wireline.

10. The apparatus of claim 9 wherein:

said probe engaging means comprises:

a mandrel connected to said pressure actuated upper ball valve operating means; and a lug extending inwardly from said mandrel; and said probe assembly portion comprises:

a body portion; and a J-slot member disposed on said body portion and defining a J-slot therein for receiving and engaging said lug.

11. The apparatus of claim 10 wherein said J-slot member is rotatable with respect to said body portion.

12. The apparatus of claim 10 wherein said J-slot is at least partially defined by a wall adapted for contacting said lug when said probe assembly portion is raised on said wireline.

13. The apparatus of claim 9 wherein said probe assembly portion is releasable from said probe engaging means after opening of said upper ball valve.

14. The apparatus of claim 9 comprising means for jarring a portion of said probe assembly portion with respect to said probe engaging means.

15. The apparatus of claim 14 wherein said jarring means comprises:

a jar adapter;

a jar mandrel connected to said jar adapter; and a jar case slidably disposed with respect to said jar adapter and jar mandrel for selectively providing a jarring impulse to at least one of said jar adapter and jar mandrel.

16. The apparatus of claim 15 further comprising means for preventing relative rotation between said jar case and said jar mandrel.

17. A method of surging a well comprising the steps of:

positioning, at a predetermined position in a well bore of said well, a tool string comprising upper and lower spaced ball valves and a packer;

initially orienting said ball valves in a closed position such that a surge chamber is defined therebetween;

setting said packer into sealing engagement with said well bore at a position above a zone to be surged;

after setting said packer, opening said lower ball valve such that fluid is surged from said well zone into said tool string past said open lower ball valve and into said surge chamber; and selectively opening said upper ball valve by at least one of pressure actuated and mechanical actuated ball valve operating means wherein, when said upper ball valve is opened by said mechanical actuating means, said step of opening said upper ball valve comprises lowering a probe assembly into said tool string for engaging a portion thereof.

18. A method of surging a well comprising the steps of:

positioning, at a predetermined position in a well bore of said well, a tool string comprising upper and lower spaced ball valves and a packer;

initially orienting said ball valves in a closed position such that a surge chamber is defined therebetween;

setting said packer into sealing engagement with said well bore at a position above a zone to be surged;

after setting said packer, opening said lower ball valve such that fluid is surged from said well zone into said tool string past said open lower ball valve and into said surge chamber; and selectively opening said upper ball valve by at least one of pressure actuated and mechanical actuated ball valve operating means, wherein said step of opening said upper ball valve is initially attempted by using said pressure actuated ball valve operating means and comprises subsequently using said mechanical actuated ball valve operating means if opening said upper ball valve is not accomplished by pressure actuation.

19. The method of claim 18 wherein using said mechanically actuated ball valve operating means comprises lowering a probe assembly on a wireline into said tool string and engaging said pressure actuated ball valve operating means such that at least a portion of said pressure actuated ball valve operating means may be mechanically lifted by raising said wireline.

20. The method of claim 19 further comprising removing said probe assembly from said tool string after said upper ball valve is opened.

* * * * *